US007629545B1

(12) United States Patent
Asner

(10) Patent No.: US 7,629,545 B1
(45) Date of Patent: Dec. 8, 2009

(54) IMPACT-ACTIVATED TRIGGER WITH OMNI-DIRECTIONAL SENSOR

(76) Inventor: Jerome L. Asner, 3909 Harvey Pkwy., Oklahoma City, OK (US) 73118

( * ) Notice: Subject to any disclaimer, the term of this patent is extended or adjusted under 35 U.S.C. 154(b) by 622 days.

(21) Appl. No.: 10/908,971

(22) Filed: Jun. 2, 2005

(51) Int. Cl.
*H01H 35/14* (2006.01)

(52) U.S. Cl. ..... 200/61.45 R; 307/121

(58) Field of Classification Search ..... 200/61.45 R–61.53; 307/121, 9.1, 10.1; 340/436–438, 340/669

See application file for complete search history.

(56) References Cited

U.S. PATENT DOCUMENTS

| | | | | |
|---|---|---|---|---|
| 2,178,159 | A | 10/1939 | Battestin et al. | |
| 2,778,896 | A | 1/1957 | Tollefsen | |
| 2,879,349 | A | 3/1959 | Thompson | |
| 3,368,044 | A | 2/1968 | Green et al. | |
| 3,673,362 | A | 6/1972 | Carlson et al. | |
| 3,723,681 | A | 3/1973 | Haruna et al. | |
| 3,745,277 | A | 7/1973 | Shawcross et al. | |
| 4,012,611 | A * | 3/1977 | Petersen | 200/61.45 R |
| 4,032,733 | A | 6/1977 | Meisenheimer, Jr. | |
| 4,081,052 | A | 3/1978 | Scharer | |
| 4,312,225 | A | 1/1982 | Williams | |
| 4,337,402 | A | 6/1982 | Nowakowski | |
| 4,715,281 | A | 12/1987 | Dinger et al. | |
| 5,285,032 | A | 2/1994 | Robinette | |
| 5,410,914 | A | 5/1995 | Sasaki et al. | |
| 5,473,307 | A | 12/1995 | Lam | |
| 5,475,372 | A | 12/1995 | Burke | |
| 5,477,019 | A | 12/1995 | Dolling | |
| 5,481,139 | A * | 1/1996 | Lucas | 200/61.5 |
| 5,596,382 | A | 1/1997 | Bamford | |
| 5,684,336 | A * | 11/1997 | McCurdy | 200/61.45 R |
| 6,034,614 | A * | 3/2000 | Haley | 200/61.45 R |

FOREIGN PATENT DOCUMENTS

| | | |
|---|---|---|
| EP | 0500504 A1 | 8/1992 |

OTHER PUBLICATIONS

Abstract of Patent EP0500504.

* cited by examiner

*Primary Examiner*—Renee S Luebke
*Assistant Examiner*—Marina Fishman
(74) *Attorney, Agent, or Firm*—Mary M. Lee

(57) ABSTRACT

An omni directional impact-activated trigger assembly. The trigger comprises a switch mechanism that controls the activation of an operation, such as an electrical circuit, so that movement of the switch opens or closes the circuit. One specific application of this trigger is to activate an ignition shut-off circuit in a vehicle or some other electrical device in response to an impact. A spherical weight is suspended for omni directional movement by flexible suspension ligaments that transmit movement of the weight to a contact member that engages the switch. Rapid acceleration or deceleration of the frame or any impact received by the frame will register as a movement of the sphere, which in turn causes movement of the contact member toward an engaged position. An adjustable biasing member is tensioned to control the degree of impact necessary to activate the switch.

9 Claims, 2 Drawing Sheets

IMPACT-ACTIVATED TRIGGER WITH OMNI-DIRECTIONAL SENSOR

FIELD OF THE INVENTION

The present invention generally relates to impact-activated triggers.

BACKGROUND OF THE INVENTION

When an electrical device receives a potentially damaging blow, an automatic shut-off switch that shuts off current to the device may prevent further damage to the device and its surroundings. For example, it is common to provide an impact switch in vehicles so that, in the event of a crash, the current to the ignition circuit is disconnected or a fuel feed valve is tripped to cut off, or both. Similarly, it is advantageous in toys, such as model airplanes, to shut off the fuel automatically upon impact. Many devices have been designed for this purpose. However, there remains a need for a simple, sturdy device that is equally sensitive to an impact from any direction.

SUMMARY OF THE INVENTION

The present invention comprises an impact trigger assembly. The assembly comprises a frame. A switch is mounted in the frame, the switch being movable between an inactive position and an active position so that in the active position the switch activates an operation. The assembly includes a contact member movable between a resting position and a retracted position. The contact member is engageable with the switch so that as the contact member moves toward the retracted position the switch moves toward the active position.

Also provided is a biasing member tensioned to urge the contact member toward the resting position. A spherical weight is suspended resiliently in the frame by a plurality of flexible suspension ligaments. The ligaments connect the weight to the contact member. Thus, the ligaments support the weight for omni directional movement in response to an impact received by the frame from any direction. In this way, movement of the sphere in any direction is transmitted to the contact member to cause the contact member to move toward the retracted position.

DETAILED DESCRIPTION OF THE PREFERRED EMBODIMENT

Figure 1:
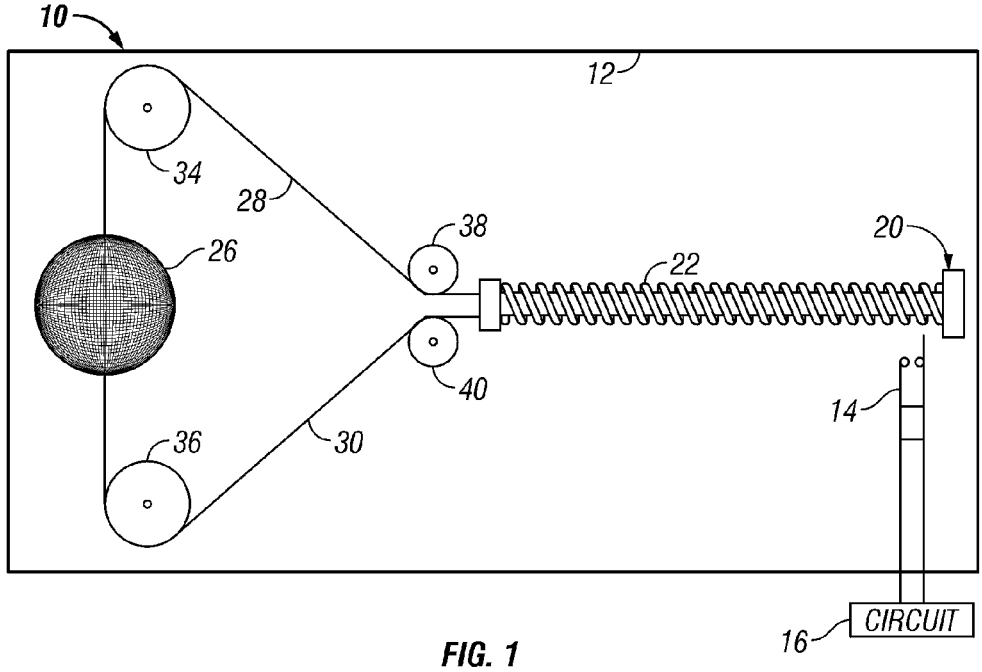
FIG. 1 is a schematic illustration of a trigger assembly constructed in accordance with the present invention. In this view, the trigger has not been tripped and the switch is in the deactivated state.
Figure 2:
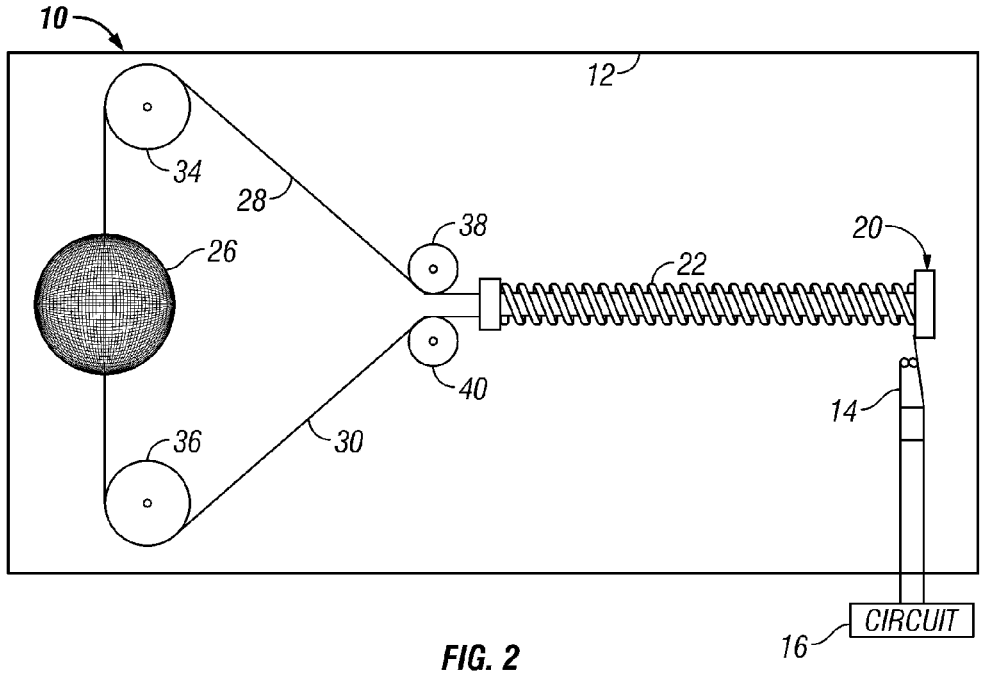
FIG. 2 is a schematic illustration of the trigger assembly of FIG. 1 showing the trigger after it has been tripped and moving the switch to the activated state.

Turning now to the drawings in general and to FIGS. 1 and 2 in particular, there is shown therein an impact-activated trigger assembly made in accordance with the present invention and designated generally by the reference numeral 10. The trigger assembly 10 comprises a frame 12 as may be provided by a casing or housing, which is illustrated only schematically in the drawings.

The assembly 10 comprises a switch 14 mounted in or on the frame 12 in any suitable manner. The switch 14 is movable between an inactive position, shown in FIG. 1, and an active position, shown in FIG. 2. In the inactive position, shown in FIG. 1, the switch 14 in the resting or inactive position in this embodiment is open. However, it will be appreciated that the switch 14 could be closed in the resting or inactive position and open in the active position. That is, "inactive" refers to the untripped trigger preceding an activating blow, and "active" refers to the condition of the switch assembly after a blow or impact has activated it.

Referring still to FIGS. 1 and 2, the trigger assembly 10 is designed to control the activation of an operation. The operation initiated by the trigger assembly 10 may be of any sort, mechanical or electrical. For purposes of illustration, in the present embodiment, the switch 14 is connected to an electrical circuit 16 supplying electrical current to a load (not shown). For example, the electrical circuit 16 may be an ignition shut-off circuit in a vehicle for example, and the assembly 16 is designed to activate the shut-off circuit in the event of a crash or other sudden impact, or sudden acceleration or deceleration. As used herein, "impact" denotes broadly any event causing the rapid or sudden acceleration or deceleration of the frame 12 and includes but is not limited to the effect of the frame receiving a blow from another object.

With continuing reference to FIGS. 1 and 2, the trigger assembly 10 further comprises a contact member 20 for activating the switch 12. The contact member 20 is movable between a resting position and an engaged position. In the resting position, shown in FIG. 1, the contact member 20 is out of contact with the switch 14, allowing the switch to remain in the inactive position. In FIG. 2, the contact member 20 is in the engaged position, moving the switch 14 to the active position to close the circuit 16. Thus, as the contact member 20 moves a selected distance toward the engaged position, the switch 14 moves toward the active position.

In the preferred embodiment, the trigger assembly 10 further includes a biasing member tensioned to urge the contact member 20 toward the resting position. While the biasing member may take any of several forms, a simple mechanism is a spring, and preferably a coil spring 22.

Referring still to FIGS. 1 and 2, the trigger assembly 10 includes an impact sensor, preferably in the form of a spherical mass or weight 26, suspended resiliently in the frame 12 for omni directional movement in response to an impact from any direction. The weight 26 is connected to the contact member 20 so that movement of the weight in any direction is transmitted to the contact member to cause the contact member to move toward the engaged position. To that end, the weight 26 is suspended by a plurality of flexible suspension ligaments. Preferably, the plurality of suspension ligaments comprises two wires 28 and 30 attached at opposite sides of the weight 26 as shown. However, it will be appreciated that "ligaments" as used herein denotes any flexible filament or elongated element, such as cables, band, strings or the like.

While various structures will serve to support the wires 28 and 30, one preferred manner of supporting the wires is by means of pulleys mounted in the frame 12. In the exemplary configuration illustrated in FIGS. 1 and 2, the pulleys comprise a first pair of pulleys 34 and 36 and a second pair of pulleys 38 and 40. The first pair of pulleys 34 and 36 support the wires 28 and 30 with the weight 26 therebetween. The second pair of pulleys 38 and 40 captures the wires and supports them for connection to the contact member 20. In lieu of pulleys, guides, channels, cable thimbles and the like configured to support the ligaments may be employed.

Figure 3:
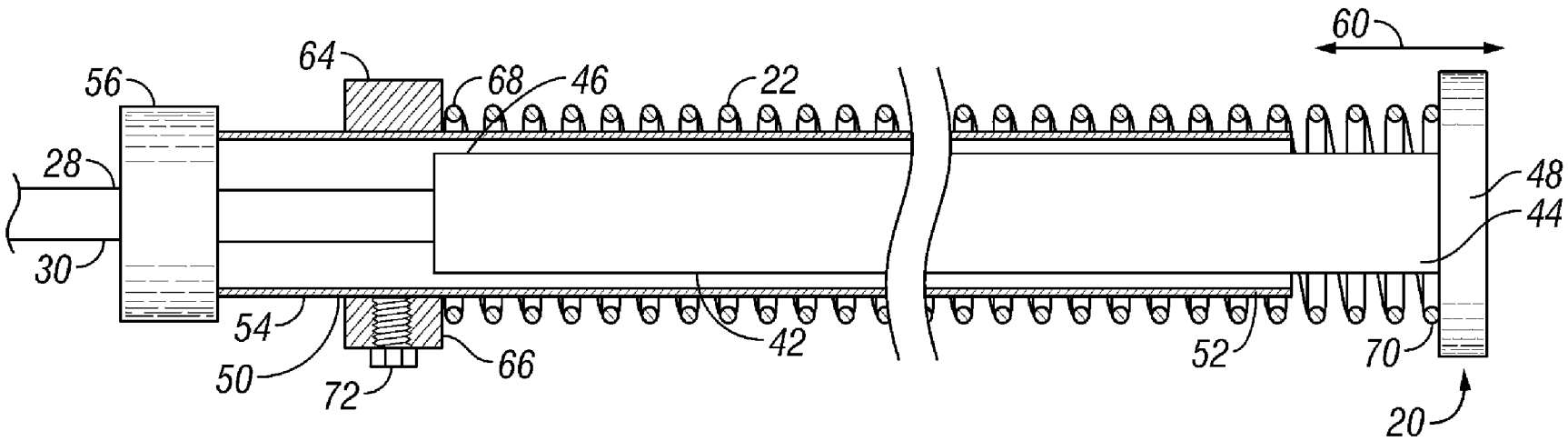
FIG. 3 is an enlarged fragmented view of the adjustable spring assembly that biases the trigger in the open or deactivated state.

In the preferred practice of the present invention, the contact member 20 is supported for linear movement, that is, movement axially along a straight line, between the resting position and the engaged position. One suitable mechanism for accomplishing this is shown in detail in FIG. 3, to which attention now is directed.

The contact member 20 preferably comprises an elongate rod 42 with first and second ends 44 and 46. The first end 44 comprises a head 48. Also part of the preferred contact member 20 is a tube 50 with an open first end 52 and second end 54. The second end 54 comprises a base 56 which provides a convenient means for fixing the contact member to the frame 12 in a manner not shown. The second end 46 of the rod 42 is telescopically received in the open first end 52 of the tube 50 for axial movement in the direction of the arrow 60. The suspension wires 28 and 30 are attached to the second end 46 of the rod 42, preferably through openings (not shown) in the base 56. Thus, movement of the weight 26 (FIGS. 1 and 2) in any direction results in concomitant axial movement of the head 48 toward the engaged position.

Preferably, the biasing member includes a spring abutment shoulder on the tube 50 between the head 48 on the rod 42 and the base 56 on the tube 50. More preferably, an annular collar 64 is slidably mounted near the second end 54 of the tube 50. The collar 64 can then form the abutment shoulder 66 for one end 68 of the coil spring 22, which is positioned over or surrounding the tube 50, while the second end 70 of the spring 22 engages the head 48 of the rod 42. Thus, the spring 22 is captured between the collar 64 and the head 48 and urges the head toward the resting position.

In most applications, it will be advantageous to make the tension on the spring 22 adjustable, which permits adjustment of the degree of impact effective to activate the switch 14. For example, if the impact force necessary to trip the trigger is adjustable, this trigger assembly may be used to detect damaging impacts to shipped products. To that end, the collar 64 is slidably mounted on the tube 50. Its position thereon is securable with a set screw 72 or some similar device.

Now it will be appreciated that the impact switch assembly of the present invention provides a simple but sturdy mechanism to trigger the activation of an operation, such as an ignition shut-off circuit. The spherical weight is suspended in a manner that permits it to respond to sudden movement of the frame in any direction. The size, weight and other characteristics of the sensor and the suspension ligaments, as well as the biasing member will be selected based on the intended application, and may be configured to respond to only a delicate movement or a stunning blow. The degree of impact of acceleration/deceleration required to activate the switch in any particular trigger assembly is adjustable by means of simple tension spring with an adjustable abutment collar.

Changes can be made in the combination and arrangement of the various parts and elements described herein without departing from the spirit and scope of the invention as defined in the following claims.

What is claimed is:

1. An impact-activated trigger comprising:

a frame;

a switch mounted in the frame, the switch being movable between an inactive position and an active position so that in the active position the switch activates an operation; and a contact member movable between a resting position and an engaged position and engageable with the switch so that, as the contact member moves toward the engaged position, the switch moves toward the active position;

a biasing member tensioned to urge the contact member toward the resting position;

a spherical weight; and a plurality of flexible suspension ligaments connecting the weight to the contact member, the ligaments being adapted to suspend the weight resiliently in the frame for omni directional movement in response to an impact from any direction, so that movement of the sphere in any direction is transmitted to the contact member to cause the contact member to move toward the engaged position.

2. The trigger assembly of claim 1 wherein the switch is an electrical switch comprised in an electrical circuit supplying current to a load.

3. The trigger assembly of claim 1 wherein the plurality of suspension ligaments consists essentially of two suspension ligaments attached at opposite sides of the sphere.

4. The trigger assembly of claim 1 wherein the suspension ligaments are wires supported on pulleys mounted in the frame.

5. The trigger assembly of claim 1 wherein the contact member is supported for linear movement between the resting position and the engaged position.

6. The trigger assembly of claim 1 wherein biasing member comprises a spring.

7. The trigger assembly of claim 6 wherein the contact member comprises:

a tube with first open end and a second end with a base, the base being supported on the frame;

a rod having first and second ends, wherein the first end comprises a head and wherein the second end is telescopically receivable in the tube through the first open end of the tube;

wherein the suspension ligaments are connected to the second end of the rod and the head is adapted to engage the switch;

a spring abutment shoulder provided on the tube between the head on the rod and the base on the tube; and wherein the spring is a coil spring surrounding the tube and captured between the head of the rod and the abutment shoulder of the tube.

8. The trigger assembly of claim 7 wherein the biasing member further comprises an annular collar supported on the tube between the spring and the base of the tube, and wherein the annular collar defines the abutment shoulder.

9. The trigger assembly of claim 8 wherein the annular collar is axially movable on the tube so that the tension on the spring is adjustable.

* * * * *